US011963597B2

(12) United States Patent
Igwegbe

(10) Patent No.: US 11,963,597 B2
(45) Date of Patent: Apr. 23, 2024

(54) HAIR CURLING ROD DEVICE CONFIGURED TO CREATE TIGHT SPIRAL CURLS FOR ALL HAIR TEXTURES WITH OR WITHOUT THE USE OF HEAT

(71) Applicant: Ezinne Igwegbe, Fort Mill, SC (US)

(72) Inventor: Ezinne Igwegbe, Fort Mill, SC (US)

( * ) Notice: Subject to any disclaimer, the term of this patent is extended or adjusted under 35 U.S.C. 154(b) by 205 days.

(21) Appl. No.: 17/539,049

(22) Filed: Nov. 30, 2021

(65) Prior Publication Data

US 2023/0165351 A1 Jun. 1, 2023

(51) Int. Cl.
*A45D 7/00* (2006.01)
*A45D 2/12* (2006.01)

(52) U.S. Cl.
CPC ..... *A45D 2/122* (2013.01); *A45D 7/00* (2013.01)

(58) Field of Classification Search
CPC ... A45D 2/02; A45D 2/04; A45D 2/06; A45D 2/12; A45D 2/122; A45D 2/14; A45D 2/141; A45D 2/2414; A45D 2/2428; A45D 2/2435; A45D 2/28; A45D 8/02; A45D 8/04; A45D 8/06
See application file for complete search history.

(56) References Cited

U.S. PATENT DOCUMENTS 1,338,388 A * 4/1920 Maker ..... A45D 2/141 132/260
1,400,812 A * 12/1921 Goldsmith, Jr. ..... A45D 2/141 132/260
1,492,398 A * 4/1924 Ross ..... A45D 2/141 132/260
2,076,521 A 4/1937 List
2,188,028 A 1/1940 Andrea
2,387,822 A 10/1945 Basky
2,648,340 A 8/1953 Swenson et al.
3,126,896 A 3/1964 Lehn et al.
3,241,561 A 3/1966 Richmond
3,289,680 A 12/1966 Kubiak
3,376,875 A 4/1968 Rosan
3,498,300 A 3/1970 Lehn
3,862,637 A 1/1975 Petri
3,927,685 A 12/1975 Bontempi
(Continued)

FOREIGN PATENT DOCUMENTS

DE 390539 * 4/1933
DE 449225 * 6/1936

*Primary Examiner* — Rachel R Steitz
(74) *Attorney, Agent, or Firm* — Jeffrey C. Watson, Esq.; Grell & Watson Patent Attorneys LLC

(57) ABSTRACT

A hair curling rod device for creating tight spiral curls for all hair textures, with or without the use of heat includes a top member and a bottom member. The top member has a relatively flat orientation and a flat bottom side. The bottom member has a convex orientation to the top member and a substantially circular cross-section. The top member is connected to the bottom member at a first end by a U-shaped connection. The U-shaped connection biases the top member toward the bottom member. The top member has a first length and the bottom member has a second length. Where the second length is longer than the first length, where the bottom member extends beyond the top member at a second end. The bottom member has an upward angled portion at the second end where the bottom member extends beyond the top member at the second end.

19 Claims, 5 Drawing Sheets

(56) References Cited

U.S. PATENT DOCUMENTS

| | | | | |
|---|---|---|---|---|
| 4,192,327 | A | 3/1980 | Vasiliou | |
| 4,381,791 | A | 5/1983 | Van Sickle | |
| 5,193,558 | A | 3/1993 | Squatrito | |
| 5,881,740 | A * | 3/1999 | Lehmann | A45D 2/2435 132/249 |
| 2015/0230578 | A1* | 8/2015 | Sze | B21G 7/06 140/87 |

* cited by examiner

HAIR CURLING ROD DEVICE CONFIGURED TO CREATE TIGHT SPIRAL CURLS FOR ALL HAIR TEXTURES WITH OR WITHOUT THE USE OF HEAT

FIELD OF THE DISCLOSURE

The present disclosure relates to the field of hairdressing. More specifically, the present disclosure is directed toward a curling rod device and hair curling technique used for the formation of spiral curls/coils/ringlets for all hair textures, with or without heat.

BACKGROUND

Generally speaking, a hair roller or hair curler is a small tube that is rolled into a person's hair in order to curl it, or to straighten curly hair, making a new hairstyle. The diameter of a roller varies from approximately 0.8 inches (20 mm) to 1.5 inches (38 mm). A hot roller or hot curler is designed to be heated in an electric chamber before one rolls it into the hair. A hair dryer heats the hair after the rolls are in place. When the hair is heated, the rollers strain and break the hydrogen bonds of each hair's cortex, which causes the hair to curl. The hydrogen bonds reform after the hair is moistened. Alternatively, hair spray can temporarily fix curled hair in place.

There are many hair curling devices available for the purpose of creating heatless spiral curls. However, the instant disclosure recognizes the challenge in the ability to easily and effectively secure hair tresses to such known devise. The majority of existing curl rods lack ease of use, hence time spent in the curling process is a big disadvantage. As an example, some existing curl rods use a form of rubber straps extending from one end of the rod and is stretched over the wound hair tress to a fastening socket at the other end in order to hold the curl in place on the rod. This is not always easy to achieve unless one is a skilled hair dresser. The tip of hair tresses tends to slip out from the securing rubber straps and ruin the curl formation process. A great deal of devices require excess hair manipulation or pulling of hair tresses when attempting to effectively secure the curl on the rod. Some hair textures require excess re-moistening and/or chemical products in order to effectively hold looped curls in place and achieve the desired spiral curl. Clearly, there is a need and/or desire to provide a curling rod device and/or method of use thereof that is easier to use.

In addition, the instant disclosure recognizes the cumbersome nature or size of most existing curl rods and discomfort in wearing such large curling rods. As a result, there is clearly a need to provide a curling rod device that is less cumbersome and more comfortable to wear.

Furthermore, the instant disclosure recognizes the dangers of using heated curling rods, especially when used by children. Accordingly, there is clearly a need to provide a curling rod device that is safe to use, especially with children, and does not require heat.

The instant disclosure may be designed to address at least certain aspects of the problems or needs discussed above by providing a hair curling rod device for creating tight spiral curls for all hair textures, with or without the use of heat.

SUMMARY

The present disclosure may solve the aforementioned limitations of the currently available curling devices, by providing the disclosed hair curling rod device. The disclosed hair curling rod device may be for creating tight spiral curls for all hair textures, with or without the use of heat. In general, the hair curling rod device may include a top member and a bottom member. The top member may have a relatively flat orientation and a flat bottom side. The bottom member may have a convex orientation to the top member and a substantially circular cross-section. The top member may be connected to the bottom member at a first end by a U-shaped connection. The U-shaped connection may bias the top member toward the bottom member. The top member may have a first length and the bottom member may have a second length. Where the second length may be longer than the first length, where the bottom member extends beyond the top member at a second end. The bottom member may have an upward angled portion at the second end. The upward angled portion may be positioned where the bottom member extends beyond the top member at the second end.

One feature of the disclosed hair curling rod device may be that the top member is configured to clamp down onto hair wrapped around the bottom member and apply pressure on the hair wrapped around the bottom member via the flat bottom side. Whereby, the hair curling rod device is configured to curl, spiral, or ringlet the hair wrapped around the bottom member without the need for heat.

In select embodiments of the disclosed hair curling rod device, the top member and the bottom member may include a soft exterior. In select embodiments, the soft exterior may be a soft silicone material. In other select embodiments, the top member and the bottom member with the U-shaped connection may be integrally formed by a metal material with a soft silicone material applied thereto for creating the soft exterior.

In select embodiments of the disclosed hair curling rod device, the bottom member may include a cylindrical tube sleeve. The cylindrical tube sleeve may extend from the U-shaped connection at the first end to before the upward angled portion at the second end. In select embodiments, the cylindrical tube sleeve may include a smooth exterior. The smooth exterior may be configured for winding of hair around the cylindrical tube sleeve and for removal of the wound hair around the cylindrical tube sleeve by siding the wound hair off of the smooth exterior of the cylindrical tube sleeve. The cylindrical tube sleeve may be configured to conform to the convex orientation of the bottom member. In select embodiments, the cylindrical tube sleeve may be a plastic, rubber or silicone tube sleeve.

Another feature of the disclosed hair curling rod device may be that the upward angled portion of the bottom member may be configured for preventing hair wrapped around the bottom member from sliding off. In select embodiments, the upward angled portion may include a bulbous distal end. The bulbous distal end may be configured for aiding the upward angled portion in preventing hair wrapped around the bottom member from sliding off.

In select embodiments of the disclosed hair curling rod device, a protective cover portion may be included. The protective cover portion may be positioned on the bottom member approximate the U-shaped connection at the first end. The protective cover portion may be sized and/or positioned to extend partly around the U-shaped connection. In select embodiments, the protective cover portion may be sized and configured to prevent the bottom member and the U-shaped connection from rubbing or being in contact with a scalp when in use. In select embodiments, the protective cover portion may be a soft tube positioned on the bottom member approximate the U-shaped connection at the first end.

In select embodiments of the disclosed hair curling rod device, a locking cap may be included. The locking cap may be configured to lock the top member onto the bottom member at the second end. In select embodiments, the locking cap may have a conical shape with a locking hole therethrough. The locking hole may be sized and configured to allow the locking cap to slide down the upward angled portion of the bottom member and onto the top member for locking the top member onto the bottom member at the second end. The locking cap may be made from any desired material configured to lock the bottom member to the top member. In select possibly preferred embodiments, the locking cap may be a soft, non-porous foam with venting holes configured to enable venting or drying of hair inside the locking cap. However, the disclosure is not so limited, and locking cap may be made from a material without the venting holes.

Another feature of the disclosed hair curling rod device, may be that in select embodiments, a combination of the locking cap and the protective cover portion positioned on the bottom member approximate the U-shaped connection at the first end may be configured to prevent the bottom member and the U-shaped connection from rubbing or being in contact with a scalp when in use.

In another aspect, the instant disclosure embraces the disclosed hair curling rod device in any embodiment and/or combination of embodiments shown and/or described herein.

In another aspect, the instant disclosure embraces a method of curling hair without heat. The disclosed method of curling hair without heat may generally include utilizing the disclosed hair curling rod device in any embodiment and/or combination of embodiments shown and/or described herein. As such, the disclosed method of curling hair without heat generally includes the step of providing the disclosed hair curling rod device in any embodiment and/or combination of embodiments shown and/or described herein. With the provided hair curling rod device, the disclosed method of curling hair without heat further includes the steps of: spreading the top member from the bottom member; wrapping the hair around the bottom member; and closing the top member onto the bottom member thereby clamping down onto the hair wrapped around the bottom member and applying pressure on the hair wrapped around the bottom member via the flat bottom side, whereby the hair wrapped around the bottom member is curled, spiraled, or ringleted without the need for heat.

In select embodiment of the disclosed method of curling hair without heat, the step of wrapping the hair around the bottom member may include starting from a scalp and wrapping the hair around the bottom member at the first end, and wrapping the hair around the bottom member in a spiral configuration toward the second end.

In other select embodiment of the disclosed method of curling hair without heat, the step of closing the top member onto the bottom member may include locking the top member to the bottom member by sliding a locking cap with a locking hole onto the upward angled portion of the bottom member and around the top member thereby locking the top member to the bottom member.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-9, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Figure 1A:
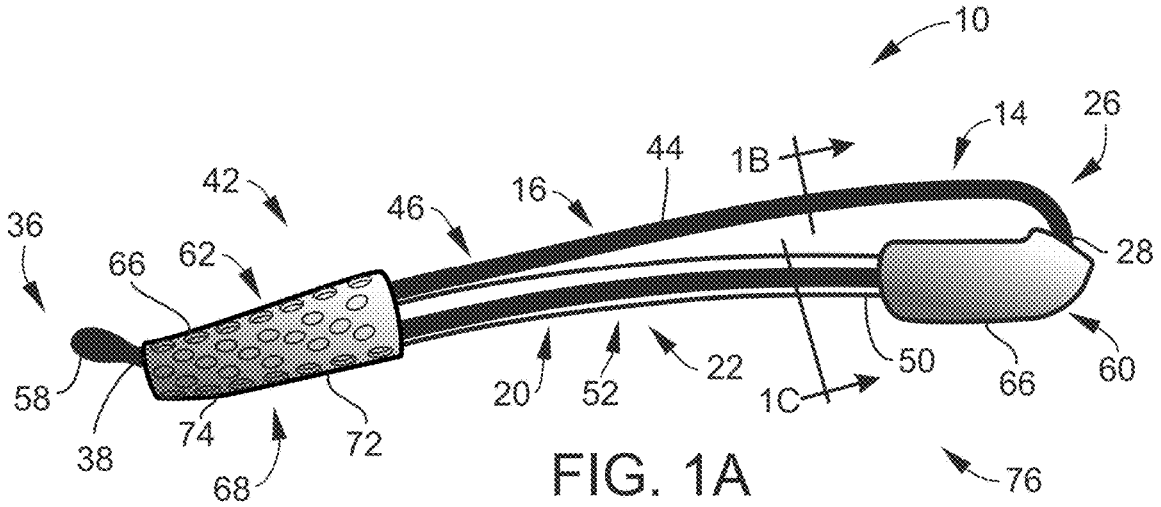
FIG. 1A is a side view of the hair curling rod device according to select embodiments of the instant disclosure in a closed position.
Figure 1B:
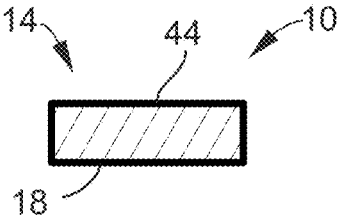
FIG. 1B is a cross-sectional view of the top member of the hair curling rod device of FIG. 1A.
Figure 1C:
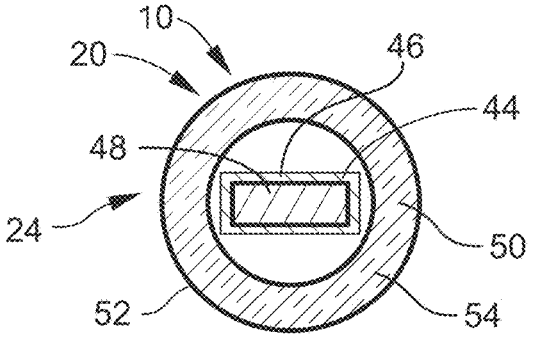
FIG. 1C is a cross-sectional view of the bottom member of the hair curling rod device of FIG. 1A.
Figure 2:
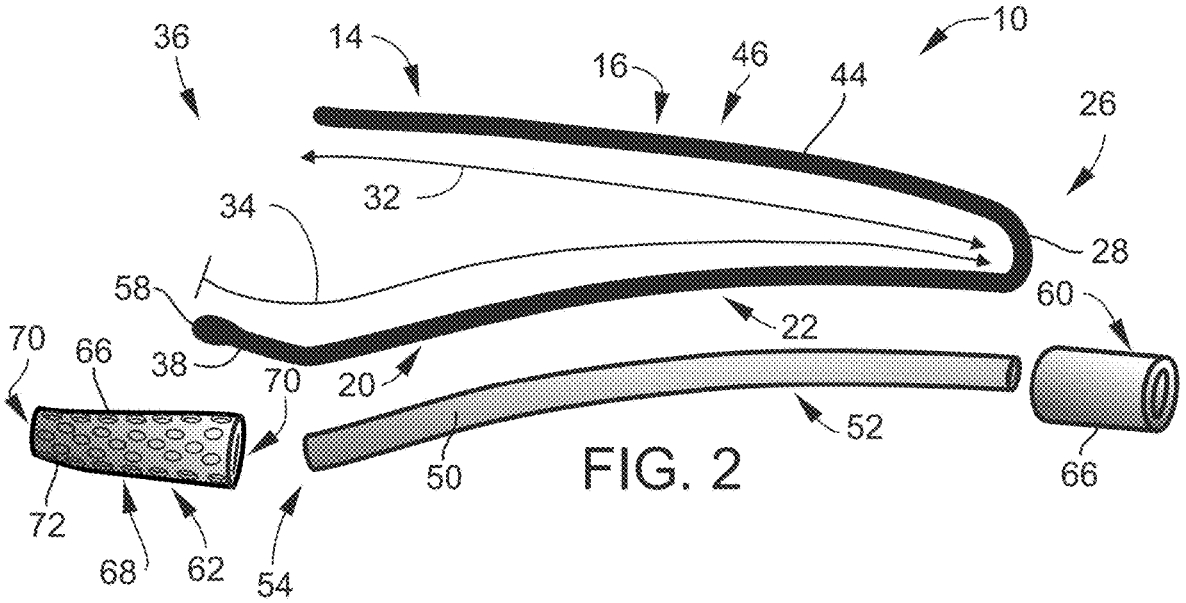
FIG. 2 is a disassembled side view of the hair curling rod device of FIG. 1.
Figure 3:
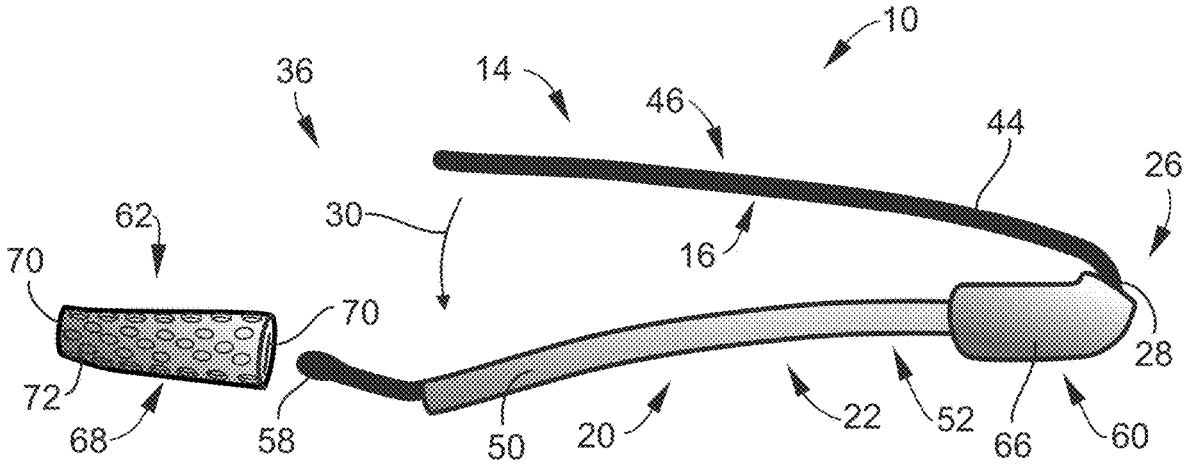
FIG. 3 is a side view of the hair curling rod device of FIG. 1 in an open position with the locking cap removed.
Figure 4:
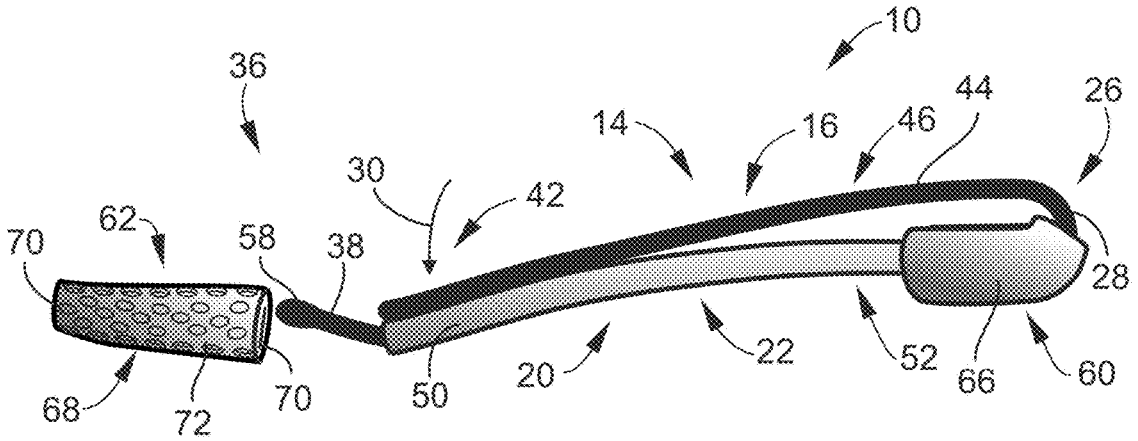
FIG. 4 is a side view of the hair curling rod device of FIG. 1 in a closed position with the locking cap ready to be attached for locking the top bar in place on top of the bottom member.
Figure 5:
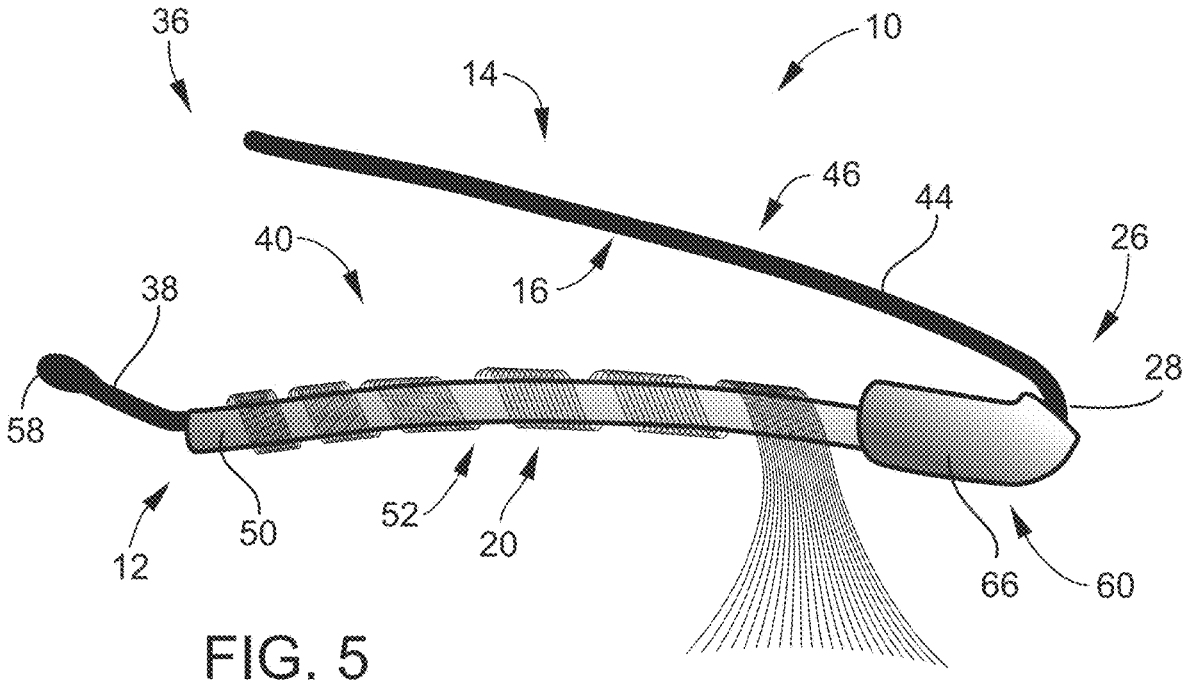
FIG. 5 is a side view of the hair curling rod device of FIG. 1 in an open position with hair wrapped around the bottom member in a finished position.
Figure 6:
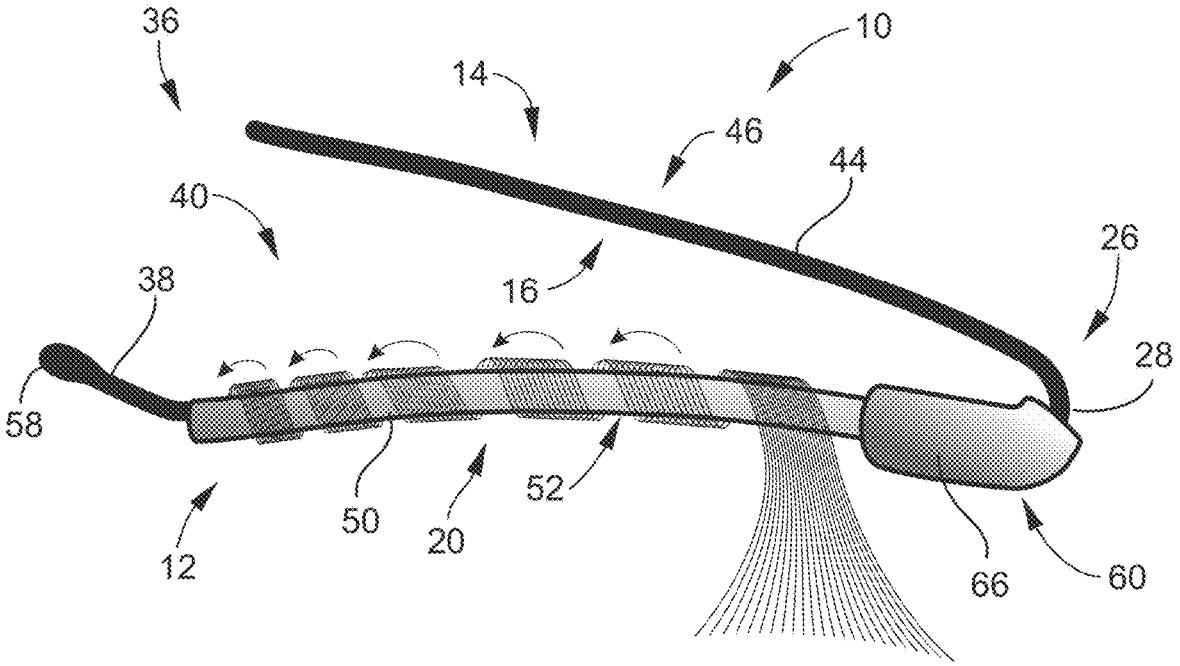
FIG. 6 is a side view of the hair curling rod device of FIG. 1 in an open position with hair wrapped around the bottom member showing the technique or sequence for wrapping the hair around the bottom member.
Figure 7:
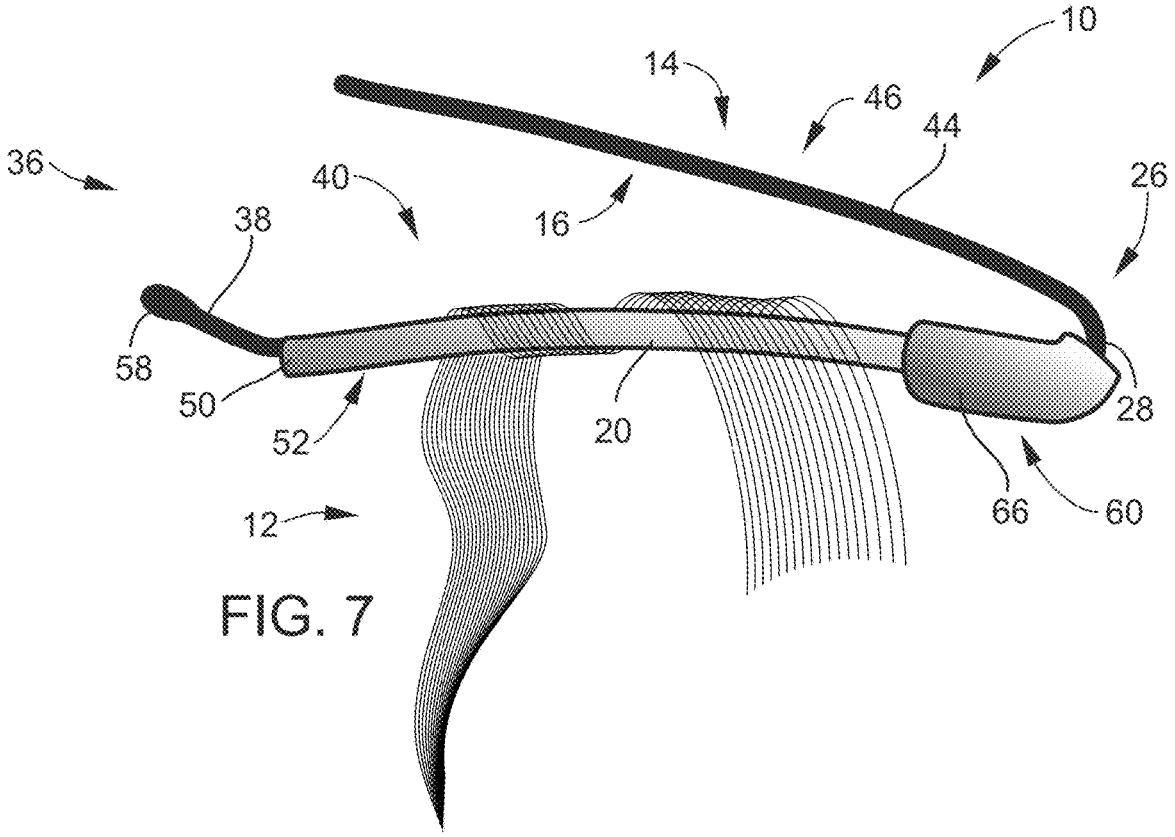
FIG. 7 is a side view of the hair curling rod device of FIG. 1 in an open position with hair wrapped around the bottom member in a starting position.

Referring now specifically to FIGS. 1-8, the present disclosure solves the aforementioned limitations of the currently available devices and methods of the currently available hair curling devices, by providing hair curling rod device 10. Hair curling rod device 10 may be for creating tight spiral curls for all hair textures, with or without the use of heat. In general, hair curling rod device 10 may include top member 14 and bottom member 20. Top member 14 may have relatively flat orientation 16 and flat bottom side 18. Relatively flat orientation 16 may mean that top member 14 may be provided with little to no curve or bending, apart from U-shaped connection 28 portion at first end 26. Flat bottom side 18, as best shown in FIG. 1B is designed to provide a flat surface at the bottom of top member 14 for applying pressure on hair 40 wrapped around bottom member 20, like as shown in FIGS. 5, 6 and 7. Bottom member 20 may have convex orientation 22 to top member 14. Convex orientation 22 of bottom member 20 may allow for pressure 42 to be applied down from top member 14 onto bottom member 20 to snap down and make bottom member 20 flatter once pressure is applied. Bottom member 20 may have substantially circular cross-section 24, as best shown in FIG. 1C. Top member 14 may be connected to bottom member 20 at first end 26 by U-shaped connection 28. U-shaped connection 28 may provide bias 30 (see FIGS. 3 and 4) from top member 14 toward bottom member 20, or vice versa, similar to a bobby pin or the like In other words, U-shaped connection 28 biases top member 14 toward bottom member 20 for creating the desired pressure 42 from top member 14 onto hair 40 wrapped around bottom member 20, like as shown in FIGS. 5, 6 and 7. U-shaped connection 28 may provide a spring clip action that closes top member 14 onto bottom member 20. As best shown in FIG. 2, top member 14 may have first length 32 and bottom member 20 may have second length 34. Second length 34 may be longer than first length 32, whereby bottom member 20 may extend beyond top member 14 at second end 36. Bottom member 20 may have upward angled portion 38 at second end 36. Upward angled portion 38 may be positioned where bottom member 20 extends beyond top member 14 at second end 36.

Referring specifically to FIGS. 3-7, one feature of hair curling rod device 10 may be that top member 14 may be configured to clamp down onto hair 40 wrapped around bottom member 20 and apply pressure 42 on hair 40 wrapped around bottom member 20 via flat bottom side 18. Whereby, hair curling rod device 10 may be configured to curl, spiral, or ringlet the hair 40 wrapped around the bottom member without the need for heat. However, the disclosure is not so limited, and although hair curling rod device 10 may be designed to be utilized without the need for heat, hair curling rod device 10 can also be used with heat, where the heat may aid in creating the desired curl and/or in reducing the time required for such desired curls to set. In addition, any other products or moisture may be utilized with hair curling rod device 10, where such other products and/or moisture may aid in creating the desired curl and/or in reducing the time required for such desired curls to set.

Referring now specifically to FIGS. 1B and 1C, in select embodiments of hair curling rod device 10, top member 14 and bottom member 20 may include soft exterior 44. Soft exterior 44 may be for providing a soft or cushioned exterior of hair curling rod device 10 for adding to the comfort and wearability of hair curling rod device 10. Soft exterior 44 may be any type or amount of cushioned exterior on hair curling rod device 10. In select possibly preferred embodiments, soft exterior 44 may be soft silicone material or shell 46. In other select embodiments, as shown in the Figures, top member 14 and bottom member 20 with the U-shaped connection 28 may be integrally formed by metal material 48 with soft silicone material or shell 46 applied thereto for creating soft exterior 44. In select embodiments, metal material 48 of top member 14 and bottom member 20 may be, but are not limited to, of similar size and shape, with similar diameters or cross-sections.

As best shown in FIGS. 1-4, in select embodiments of hair curling rod device 10, bottom member 20 may include cylindrical tube sleeve 50. Cylindrical tube sleeve 50 may be for providing the desired size and shape of a curling surface for hair curling rod device 10. Cylindrical tube sleeve 50 may be designed to be interchangeable, where various sized and shaped of cylindrical tube sleeve 50 may be positioned on hair curling rod device 10. Cylindrical tube sleeve 50 may generally extend from U-shaped connection 28 at first end 26 to before upward angled portion 38 at second end 36. In select embodiments, cylindrical tube sleeve 50 may include smooth exterior 52. Smooth exterior 52 may be configured for winding of hair 40 around cylindrical tube sleeve 50, as shown in FIGS. 5, 6 and 7, and for removal of the wound hair 40 around cylindrical tube sleeve 50 by siding the wound hair 40 off of the smooth exterior 52 of cylindrical tube sleeve 50. This aspect of providing smooth exterior 52 on the exterior of cylindrical tube sleeve 50 that allows for hair 40 to slide off of hair curling rod device 10, may allow for the set curls in the hair to be removed from hair curling rod device with minimal disturbance to the set curls. Cylindrical tube sleeve 50 may be flexible where it may be configured to conform to convex orientation 22 of bottom member 20. Cylindrical tube sleeve 50 may be made from any soft material configured for curling hair. In select possibly preferred embodiments, cylindrical tube sleeve 50 may be a plastic, a rubber, or a silicone tube sleeve 54.

As best shown in FIGS. 2-8, another feature of hair curling rod device 10 may be that upward angled portion 38 of bottom member 20 may be configured for preventing hair 40 wrapped around bottom member 20 from unintentionally sliding off. In select possibly preferred embodiments, as shown in these Figures, upward angled portion 38 may include bulbous distal end 58. Bulbous distal end 58 may be configured for aiding upward angled portion 38 in preventing hair 40 wrapped around bottom member 20 from sliding off. Bulbous distal end 58 may also be designed and/or configured to prevent injury/discomfort to scalp or fingers.

As shown in the Figures, in select embodiments of hair curling rod device 10, protective cover portion 60 may be included. Protective cover portion 60 may be for providing a protective cover for aiding in the comfort and wearability of hair curling rod device 10, like for preventing any hard surfaces of hair curling rod device 10 from rubbing or being in contact with a scalp when in use. Protective cover portion 60 may be positioned on bottom member 20 approximate U-shaped connection 28 at first end 26. As shown in the Figures, protective cover portion 60 may be sized and/or positioned to extend partly around U-shaped connection 28. As such, in select embodiments, protective cover portion 60 may be sized and configured to prevent bottom member 20 and U-shaped connection 28 from rubbing or being in contact with a scalp when in use. Protective cover 60 may be any size, shape, or design of a protective cover for hair curling rod device configured for preventing bottom member 20 and U-shaped connection 28 from rubbing or being in contact with a scalp when in use. In select embodiments, as shown in the Figures, protective cover portion 60 may be soft tube 66 positioned on bottom member 20 approximate U-shaped connection 28 at first end 26.

As shown in FIGS. 1-4 and 8, in select embodiments of hair curling rod device 10, locking cap 62 may be included. Locking cap 62 may be configured to lock top member 14 onto bottom member 20, including, but not limited to, like at second end 36. Locking cap 62 may be any shape, size, material, configuration, orientation, means or method configured to lock top member 14 onto bottom member 20. In select embodiments, as shown in the Figures, locking cap 62 may have conical shape 68 with locking hole 70 therethrough. Locking holes 70 of locking cap 62 may be sized and configured to allow locking cap 62 to slide down upward angled portion 38 (including bulbous end 58) of bottom member 20 and onto top member 14 for locking top member 14 onto bottom member 20 at second end 36. In select possibly preferred embodiments, locking cap 62 may be soft, non-porous foam 72 with venting holes 74. Venting holes 74 through locking cap 62 may be provided and configured to enable venting or drying of hair inside or around locking cap 62. However, the disclosure is not so limited, and locking cap 62 may clearly be made from a material without venting holes 74.

As best shown in FIG. 1, another feature of hair curling rod device 10, may be that in select embodiments, combination 76 of locking cap 62 and protective cover portion 60 positioned on bottom member 20 approximate U-shaped connection 28 at first end 26 may be configured to prevent bottom member 20 and U-shaped connection 28 from rubbing or being in contact with a scalp when in use. As such, combination 76 of locking cap 62 and protective cover portion 60 may be designed to provide for added comfort and wearability of hair curling rod device 10.

In another aspect, the instant disclosure embraces hair curling rod device 10 in any embodiment and/or combination of embodiments shown and/or described herein.

Figure 8:
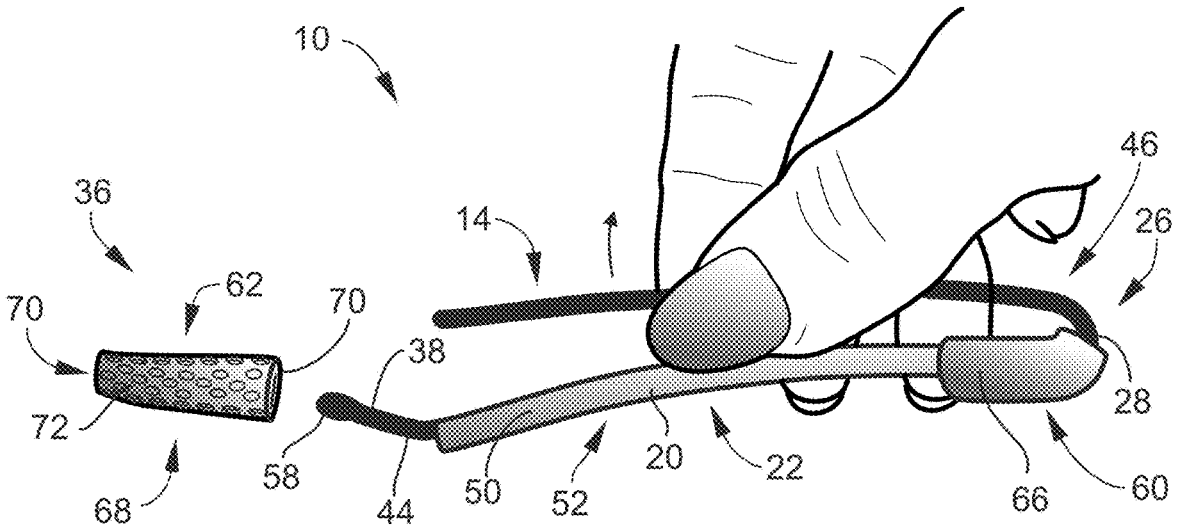
FIG. 8 is a side view of the hair curling rod device of FIG. 1 in an open position being held in one hand by a user.
Figure 9:
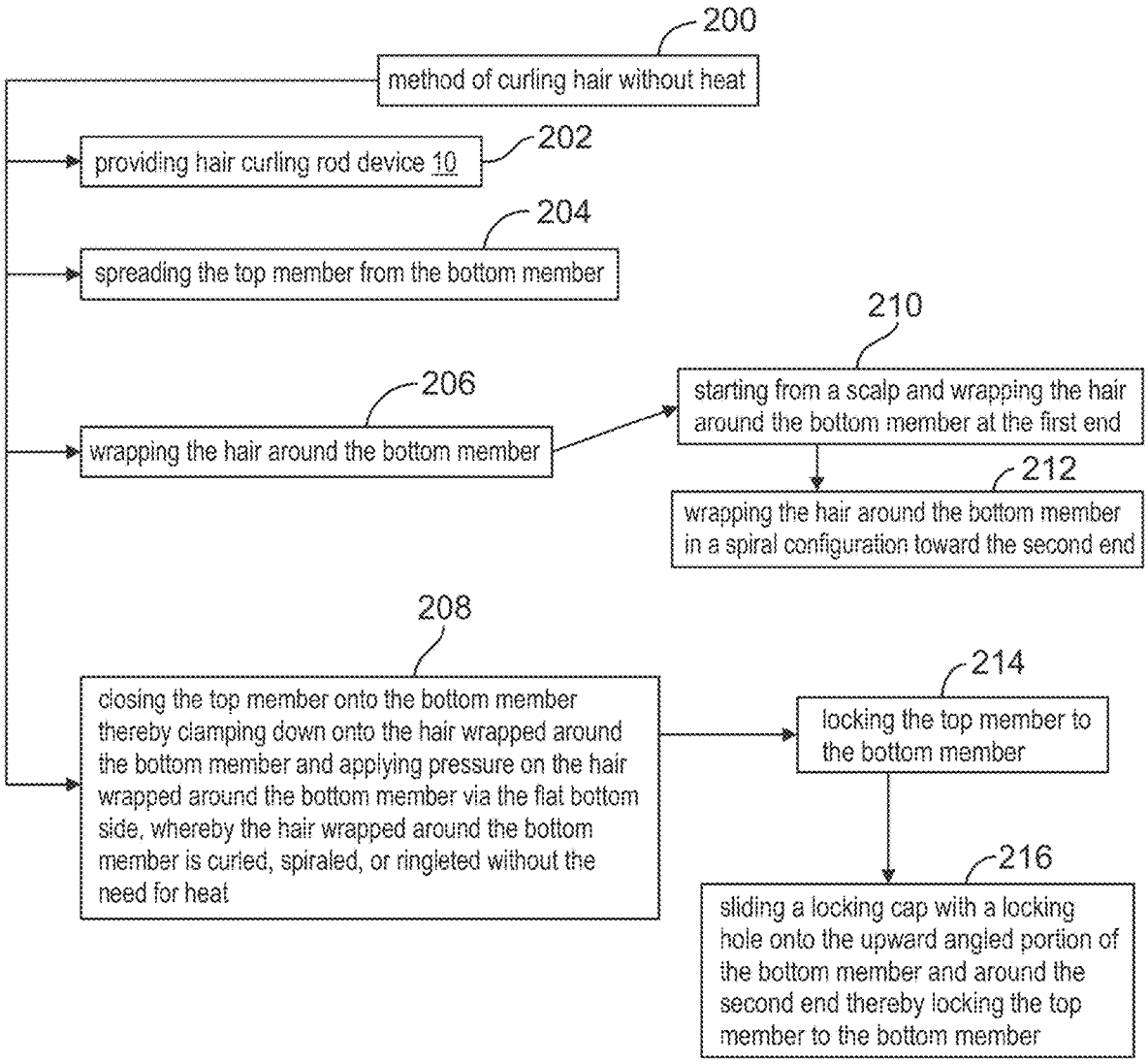
FIG. 9 is a flow chart of a method of curling hair without heat according to select embodiments of the instant disclosure.

Referring now to FIG. 9, in another aspect, the instant disclosure embraces method 200 of curling hair without heat. Method 200 of curling hair without heat may generally include utilizing hair curling rod device 10 in any embodiment and/or combination of embodiments shown and/or described herein. As such, method 100 of curling hair without heat generally includes step 202 of providing hair curling rod device 10 in any embodiment and/or combination of embodiments shown and/or described herein. With the provided hair curling rod device 10, method 200 of curling hair without heat further includes the steps of: step 204 of spreading top member 14 from bottom member 20, like via ones fingers, as shown in FIG. 8; step 206 of wrapping the hair around the bottom member (like as shown in FIGS. 5-7); and step 208 of closing top member 14 onto bottom member 20 thereby clamping down onto the hair wrapped around bottom member 20 and applying pressure on the hair wrapped around bottom member 20 via flat bottom side 18. Whereby, the hair wrapped around the bottom member 20 is curled, spiraled, or ringleted without the need for heat.

Still referring to FIG. 9, in select possibly preferred embodiments of method 200 of curling hair without heat, step 206 of wrapping the hair around bottom member 20 may include step 210 of starting from a scalp and wrapping the hair around bottom member 20 at first end 26, and step 212 of wrapping the hair around bottom member 20 in a spiral configuration toward second end 36.

Still referring to FIG. 9, in other select possibly preferred embodiments of method 200 of curling hair without heat, step 208 of closing top member 14 onto bottom member 20 may include step 214 of locking top member 14 to bottom member 20 by sliding locking cap 62 with locking hole 70 onto upward angled portion 38 of bottom member 20 and around top member 14 thereby locking top member 14 to bottom member 20.

In use, hair tresses are arranged to be wrapped in a spiral of multiple loops around the lower cylindrical sleeve 50 of bottom member 20 while flat bottom side 18 of top member 14 clamps down on the spirally wound/wrapped tresses to prevent shifting, thus effectively securing hair on bottom member 20. Hair tresses are wound around cylindrical sleeve 50 of bottom member 20 at first end 26 starting from the scalp, moving along the length of bottom member 20, to the second end 36 where the hair tresses are clamped in place. The clamping action on the spirally wrapped tresses applies pressure needed to form/set curl with or without heat. Soft locking cap 62 may be fastened onto second end 36 of hair curling rod device 10 to hold top member 14 in a closed position on bottom member 20, further securing hair tresses in place in case of disturbing activities such as workout, sleep etc. Soft locking cap 62 may consist of soft, non-porous foam 72 with tiny venting holes 74 which may enable venting/drying of hair wherein, when water/moisturizer/curl setting product is used. Soft locking cap 62, along with protective cover member 60 may prevent the metal material 48 of hair curling rod device 10 from being in contact with the scalp, which may assure maximum comfort to the wearer, as well as comfortable night's sleep if desired to be worn overnight. Second end 36 of hair curling rod device 10 is uneven, or top member 14 is disproportionate in length with bottom member 20, which provide the ease of opening top member 14 from bottom member 20 and inserting hair tresses. As shown in FIG. 8, top member 14 is spread from bottom member 20 using 2-5 fingers, where sectioned hair tresses are slipped between top member 14 and bottom member 20 and wound in a circular/spiral motion along the length of bottom member 20, from first end 26 toward second end 36 of hair curling rod device 10 (see FIGS. 5-7). Once hair is wound around bottom member 20, the finger grip is released, enabling top member 14 to clasp down on wound hair. Soft locking cap 62 may then be slipped on to complete the process.

Hair curling rod device 10 can be designed and configured with varying rod lengths and cylindrical sleeve tube sizes to accommodate different hair lengths and desired curls.

Hair curling rod device 10 may provide crossover between classic hair rollers, perm rods, and curl rod devices, that can be used on human or synthetic hair textures (wigs, extensions, doll hair etc.).

In sum, the present disclosure is directed to an innovative heatless hair curling rod device 10 that may be designed and configured to create tight spiral curls for all hair textures, with or without the use of heat. Hair rod curling device 10 may provide a construction/shape of a devise that is arranged to apply pressure to hair tresses wrapped around a soft smooth rod member/disposed in between, when the rod is in clamped/closed position, thereby causing the tresses to form curls without the need for an application of heat or use of excess hair curl setting mediums (wax, gel, foam, mousse). Optionally, water/curl setting medium may be applied to spirally wrapped tresses on rod afterwards, to facilitate the formation of curls. A great feature of the present disclosure is its ability to reduce the time spent achieving desired curls. The reduced time spent correlates with the technique used to wound hair tresses around hair rod and method used to quickly secure hair tresses to rod.

The disclosed device and method may be designed to allow curls to be spirally wound, where they are not wound on top of each other, like the classic hair rollers. Classic hair rollers described as such usually produce short, round, puffy/frizzy curls or waves. With the present disclosure, hair tresses are wound adjacently to each other in a spiral manner to achieve stretched-out/elongated defined curls (see FIG. 7), or short tight spiral curls (see FIGS. 5-6). Curls may be achieved on dry hair or with a slight spritz of water, moisturizer, or curl setting medium. This may be particularly useful for individuals that do not wash hair daily/use excess curl setting mediums/use hot tools or dryer. Water/curl setting medium may be applied after hair tresses are secured on the rod.

Another great feature of the present disclosure may be its ability to produce strong clamping action on the wound hair tresses, thereby securing the curl in place. Soft locking cap 62 may be fastened on second end 36 of hair curling rod device 10, slightly overlapping a portion of clamped hair for an ultimate hold. The clamping action/pressure of curl rod on hair tresses promotes its ability to be used without heat or application of excessive curl setting products, thereby avoiding heat damage or excessive hair manipulation/pulling force/damage. Hair curling rod device 10 may efficiently permit the clamping of hair tress for sufficient time necessary to set spiral curls.

Another feature of the present disclosure is its ability to achieve tight spiral/corkscrew-like curls on dry or slightly moistened/spritzed hair with little or no manipulations. Some hair textures may require excess re-moistening and/or chemical products in order to effectively hold looped curls in place and achieve the perfect spiral curl. The clamping action of hair curling rod device 10 may eliminate unnecessary use of hair products and forceful manipulation. Less manipulation may lead to less breakage and may promote retention of hair length over time.

Another feature of the disclosed hair curling rod device 10 may be the comfort or wearability. Most curling devices are cumbersome in size or made of hard plastic. This present disclosure is compact, and the metal core is surrounded by soft silicone. A protective soft foam locking cap 62 may be fastened/affixed onto the tip of device as well as protective cover portion 60 used at the opposite u-bend end to prevent the metal core rubbing/being in contact with the scalp. This may ensure maximum comfort for prolonged wear.

Another feature of the disclosed hair curling rod device 10 may be its versatility. The ability of the disclosed device to be use on extremely short hair due to clamping action may be revolutionary. Most curl rod devices require longer hair tresses in order to work properly. The disclosure may provide a breakthrough for all hair types, especially those with little to no natural curl pattern.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A hair curling rod device for creating tight spiral curls for all hair textures, with or without the use of heat, the hair curling rod device comprising:

a top member having a relatively flat orientation and a flat bottom side;

a bottom member having a convex orientation to the top member and a substantially circular cross-section;

the top member is connected to the bottom member at a first end by a U-shaped connection, the U-shaped connection biasing the top member toward the bottom member;

the top member has a first length and the bottom member has a second length, where the second length is longer than the first length, where the bottom member extends beyond the top member at a second end;

the bottom member having an upward angled portion at the second end, the upward angled portion is positioned where the bottom member extends beyond the top member at the second end; and a locking cap configured to lock the top member onto the bottom member at the second end, wherein the locking cap is a soft, non-porous foam with venting holes configured to enable venting or drying of hair inside the locking cap.

2. The hair curling rod device of claim 1, wherein the top member is configured to clamp down onto hair wrapped around the bottom member and apply pressure on the hair wrapped around the bottom member via the flat bottom side, whereby the hair curling rod device is configured to curl, spiral, or ringlet the hair wrapped around the bottom member without the need for heat.

3. The hair curling rod device of claim 1, wherein the top member and the bottom member including a soft exterior.

4. The hair curling rod device of claim 3, wherein the soft exterior being a soft silicone material.

5. The hair curling rod device of claim 3, wherein the top member and the bottom member with the U-shaped connection are integrally formed by a metal material with a soft silicone material applied thereto for creating the soft exterior.

6. The hair curling rod device of claim 1, wherein the bottom member including a cylindrical tube sleeve extending from the U-shaped connection at the first end to before the upward angled portion at the second end.

7. The hair curling rod device of claim 6, wherein the cylindrical tube sleeve including a smooth exterior, the smooth exterior is configured for winding of hair around the cylindrical tube sleeve and for removal of the hair wound around the cylindrical tube sleeve by siding the hair wound off of the smooth exterior of the cylindrical tube sleeve.

8. The hair curling rod device of claim 6, wherein the cylindrical tube sleeve is configured to conform to the convex orientation of the bottom member.

9. The hair curling rod device of claim 6, wherein the cylindrical tube sleeve is a plastic, rubber, or silicone tube sleeve.

10. The hair curling rod device of claim 1, wherein the upward angled portion of the bottom member is configured for preventing hair wrapped around the bottom member from sliding off.

11. The hair curling rod device of claim 10, wherein the upward angled portion including a bulbous distal end, the bulbous distal end is configured for aiding the upward angled portion in preventing the hair wrapped around the bottom member from sliding off.

12. The hair curling rod device of claim 1 further including:

a protective cover portion, the protective cover portion is positioned on the bottom member approximate the U-shaped connection at the first end.

13. The hair curling rod device of claim 12, wherein the protective cover portion is sized and configured to prevent the bottom member and the U-shaped connection from rubbing or being in contact with a scalp when in use.

14. The hair curling rod device of claim 12, wherein the protective cover portion is a soft tube positioned on the bottom member approximate the U-shaped connection at the first end.

15. The hair curling rod device of claim 12, wherein the locking cap has a conical shape with a locking hole therethrough, the locking hole is sized and configured to allow the locking cap to slide down the upward angled portion of the bottom member and onto the top member for locking the top member onto the bottom member at the second end.

16. The hair curling rod device of claim 12, wherein a combination of the locking cap and the protective cover portion positioned is configured to prevent the bottom member and the U-shaped connection from rubbing or being in contact with a scalp when in use.

17. A hair curling rod device for creating tight spiral curls for all hair textures, with or without the use of heat, the hair curling rod device comprising:

a top member having a relatively flat orientation and a flat bottom side;

a bottom member having a convex orientation to the top member and a substantially circular cross-section;

the top member is connected to the bottom member at a first end by a U-shaped connection, the U-shaped connection biasing the top member toward the bottom member;

the top member has a first length and the bottom member has a second length, where the second length is longer than the first length, where the bottom member extends beyond the top member at a second end;

the bottom member having an upward angled portion at the second end, the upward angled portion is positioned where the bottom member extends beyond the top member at the second end, the upward angled portion of the bottom member is configured for preventing hair wrapped around the bottom member from sliding off, wherein the upward angled portion including a bulbous distal end, the bulbous distal end is configured for aiding the upward angled portion in preventing the hair wrapped around the bottom member from sliding off;

wherein the top member and the bottom member with the U-shaped connection are integrally formed by a metal material with a soft silicone material applied thereto for creating a soft exterior;

the bottom member including a cylindrical tube sleeve extending from the U-shaped connection at the first end to before the upward angled portion at the second end, the cylindrical tube sleeve including a smooth exterior, the smooth exterior is configured for winding of the hair around the cylindrical tube sleeve and for removal of the hair wound around the cylindrical tube sleeve by siding the hair wound off of the smooth exterior of the cylindrical tube sleeve, the cylindrical tube sleeve is configured to conform to the convex orientation of the bottom member, wherein the cylindrical tube sleeve is a plastic, rubber, or silicone tube sleeve;

a protective cover portion, the protective cover portion is positioned on the bottom member approximate the U-shaped connection at the first end, the protective cover portion is sized and configured to prevent the bottom member and the U-shaped connection from rubbing or being in contact with a scalp when in use, the protective cover portion is a soft tube positioned on the bottom member approximate the U-shaped connection at the first end;

a locking cap configured to lock the top member onto the bottom member at the second end, the locking cap has a conical shape with a locking hole therethrough, the locking hole is sized and configured to allow the locking cap to slide down the upward angled portion of the bottom member and onto the top member for locking the top member onto the bottom member at the second end, wherein the locking cap is a soft, non-porous foam with venting holes configured to enable venting or drying of the hair inside the locking cap;

wherein a combination of the locking cap and the protective cover portion is configured to prevent the bottom member and the U-shaped connection from rubbing or being in contact with a scalp when in use; and wherein the top member is configured to clamp down onto the hair wrapped around the bottom member and apply pressure on the hair wrapped around the bottom member via the flat bottom side, whereby the hair curling rod device is configured to curl, spiral, or ringlet the hair wrapped around the bottom member without the need for heat.

18. A method of curling hair without heat comprising:

providing a hair curling rod device comprising:

a top member having a relatively flat orientation and a flat bottom side;

a bottom member having a convex orientation to the top member and a substantially circular cross-section;

the top member is connected to the bottom member at a first end by a U-shaped connection, the U-shaped connection biases the top member toward the bottom member;

the top member has a first length and the bottom member has a second length, where the second length is longer than the first length, where the bottom member extends beyond the top member at a second end;

the bottom member having an upward angled portion at the second end, the upward angled portion is positioned where the bottom member extends beyond the top member at the second end; and a locking cap configured to lock the top member onto the bottom member at the second end, wherein the locking cap is a soft, non-porous foam with venting holes configured to enable venting or drying of hair inside the locking cap;

spreading the top member from the bottom member;

wrapping the hair around the bottom member; and closing the top member onto the bottom member thereby clamping down onto the hair wrapped around the bottom member and applying pressure on the hair wrapped around the bottom member via the flat bottom side, whereby the hair wrapped around the bottom member is curled, spiraled, or ringleted without the need for heat.

19. The method of curling hair without heat of claim 18, wherein:

the wrapping of the hair around the bottom member including starting from a scalp and wrapping the hair around the bottom member at the first end, and wrapping the hair around the bottom member in a spiral configuration toward the second end;

the closing of the top member onto the bottom member including locking the top member to the bottom member by sliding a locking cap with a locking hole onto the upward angled portion of the bottom member and around the top member thereby locking the top member to the bottom member; or a combination thereof.

* * * * *